United States Patent [19]

Dinger

[11] Patent Number: 4,606,702

[45] Date of Patent: Aug. 19, 1986

[54] REVERSIBLE FAN WITH CYLINDRICAL RESILIENT RUBBER SPRING

[75] Inventor: Nelson E. Dinger, Erie, Pa.

[73] Assignee: Huber Reversible Fan, Inc., Erie, Pa.

[21] Appl. No.: 690,477

[22] Filed: Jan. 10, 1985

[51] Int. Cl.[4] ..... F04D 29/36

[52] U.S. Cl. ..... 416/206; 74/18; 267/153

[58] Field of Search ..... 416/204 R, 205, 206, 416/207, 208, 209, 244 R, 247 R, 239, 245 R; 267/153, 63 R; 74/18, 18.2

[56] References Cited

U.S. PATENT DOCUMENTS

| | | | |
|---|---|---|---|
| 2,163,893 | 6/1939 | Schairer | 416/102 |
| 2,443,201 | 6/1948 | Sluyter | 267/153 |
| 2,499,837 | 3/1950 | Sheets et al. | 416/205 |
| 2,718,268 | 9/1955 | Cushman | 416/205 |
| 2,776,107 | 1/1957 | Willi | 416/205 |
| 3,026,943 | 3/1962 | Huber | 416/206 |
| 3,080,002 | 3/1963 | DuPont | 416/102 |
| 3,263,985 | 8/1966 | Planta | 267/153 |
| 3,409,284 | 11/1968 | Rix | 267/153 |
| 3,412,990 | 11/1968 | Gladstone | 267/153 |
| 4,270,442 | 6/1981 | Bainard et al. | 74/18.2 |
| 4,369,979 | 1/1983 | Krude et al. | 74/18 |
| 4,509,730 | 4/1985 | Shtarkman | 267/153 |

FOREIGN PATENT DOCUMENTS

| | | | |
|---|---|---|---|
| 1926338 | 12/1970 | Fed. Rep. of Germany | 416/205 |
| 4223 | 2/1971 | Japan | 416/207 |
| 843995 | 8/1960 | United Kingdom | 416/207 |
| 903792 | 8/1962 | United Kingdom | 416/207 |

*Primary Examiner*—Robert E. Garrett
*Assistant Examiner*—Edward Li
*Attorney, Agent, or Firm*—Charles L. Lovercheck; Wayne L. Lovercheck; Dale R. Lovercheck

[57] ABSTRACT

A fan having reversible blades supported on a ring. The blades have means for holding the blades against rotation around thin central axis so that they can be selectively set to either blow cooling air forward away from the driver or rearward to add to the comfort of the driver. The resilient means urging the blades outward is made up of rubber cylinders that receive the hubs of the blades. One end of the cylinder rests on the fan while the thick end of the cylinder rests on the fan blades. The cylinder has a barrel shaped inside surface which it in giving the sleeved a generally uniform spring rate throughout its entire excursion.

1 Claim, 3 Drawing Figures

REVERSIBLE FAN WITH CYLINDRICAL RESILIENT RUBBER SPRING

REFERENCE TO PRIOR ART

The U.S. Pat. No. 4,140,435 to Huber and the prior art references cited therein and U.S. Pat. No. 4,396,352 to Pearce are the closest art of which Applicant is ware. None of these references show a blade support ring like Applicant discloses herein.

BACKGROUND OF INVENTION

This invention is an improvement over the reversible fan shown U.S. Pat. No. 4,140,435 issued to Herman Huber. In U.S. Pat. No. 4,140,435 a ring supports the inside of the blades is in the form of a circle. The ring carries a plurality of blades which extend radially outwardly and each blade is urged outwardly by a spring. These springs are mechanical helical springs and they permit oil and other foreign matter to move outwardly from the inside of the ring. Helical springs are also subject to fracture, distortion and are expensive. The corrosion, foreign material, breakage and fatigue could cause failure. Applicant has found that by substituting a cylindrical shaped resilient sleeve thinned at its intermediate part to increase its flexibility. Weight, cost and other previous disadvantages in helical springs can be overcome.

OBJECTS OF THE INVENTION

It is an object of the invention to provide an improved part of a reversible fan.

Another object of the invention is to provide an improved blade support ring for supporting the base of the fan.

Another object of the invention is to provide a part of a reversible fan that is simple in construction, economical to manufacture and simple and efficient to use.

Another object of the invention is to provide an improved spring in combination with a reversible fan.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWING

Figure 1:
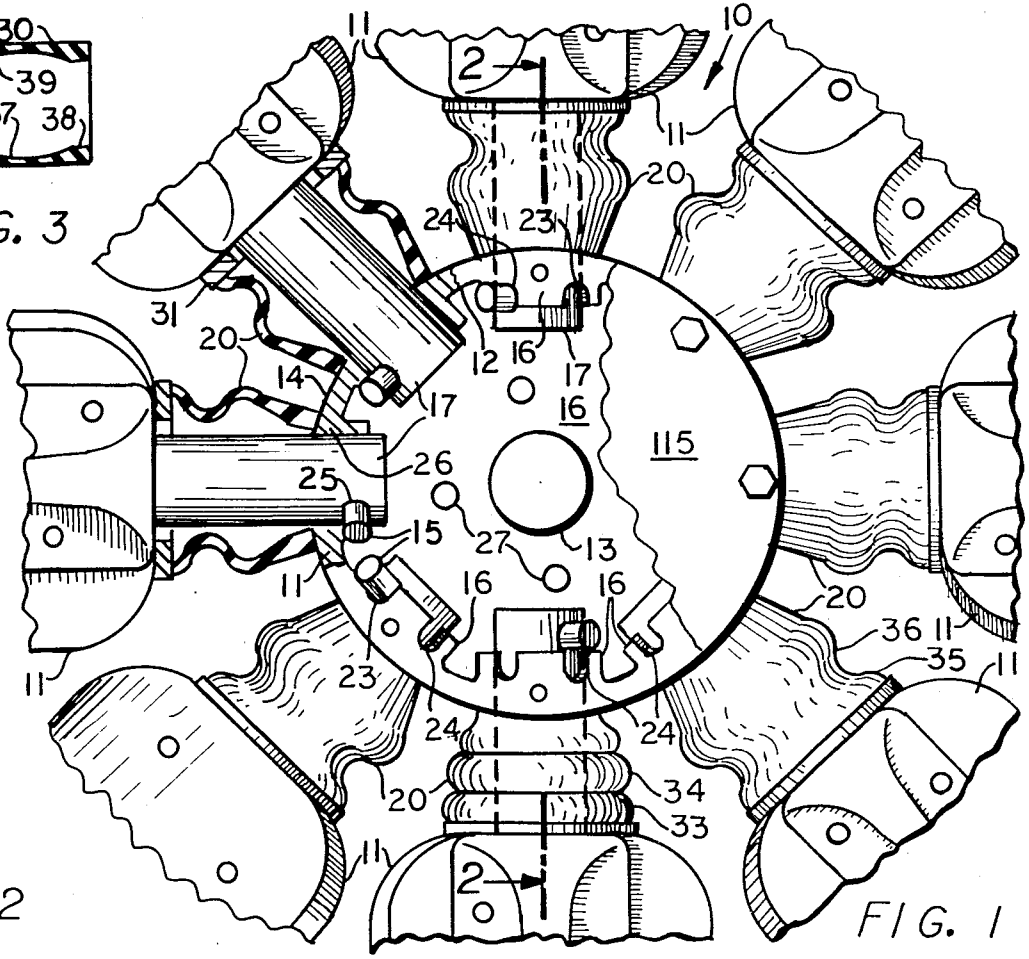
FIG. 1 is a front view of the fan and improved blade support shown partly in cross section according to the invention.
Figure 2:
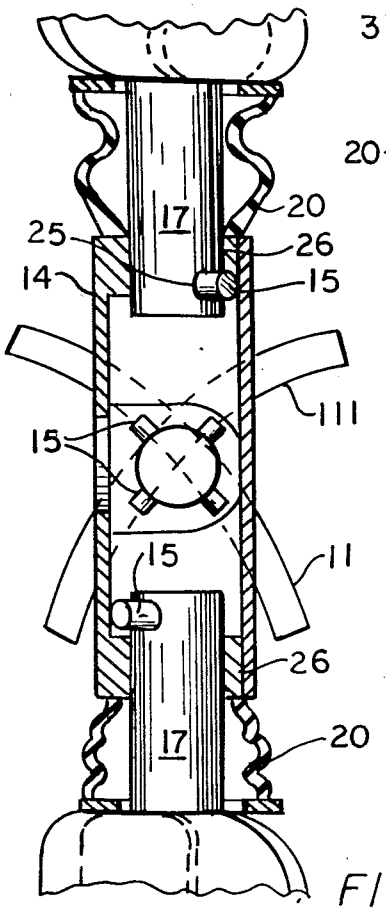
FIG. 2 is a longitudinal cross sectional view of the fan and improved blade support taken on line 2—2 of FIG. 1.
Figure 3:
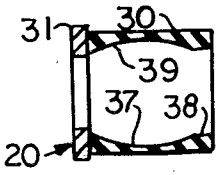
FIG. 3 is a cross sectional view of the resilient sleeve for holding the blades out according to the invention.

Now with more particular reference to the drawings. The fan, generally indicated at 10, has reversible blades 11 which may be pushed radially inward against spring pressure and rotated from a first position 11 to a second position 111 as shown in FIG. 2. The hub is made up of a ring generally indicated at 14. The ring has fixed to it an inwardly directed flange 115 which has a central shaft receiving opening 13 surrounded by holes 27 for clamping the hub to the crank shaft of an engine in a manner familiar to those skilled in the art. The ring 14 has a peripheral spaced inwardly extending nipples 16 welded to it and supported on it. The nipples 16 each have a bore 26 that receives a shaft 17 of blades 11. Spring pressure is provided by the resilient sleeves 20 each of which has its inner end resting on the outer periphery of ring 14 which has the nipples 16 fixed to its inner periphery. The nipples 16 each have two diametrically opposed slots in their inner end. The slots 23 and 24 are arranged at an acute angle to each other. The pins 15 which are received in diametrically extending holes in the inner ends of the hubs are received in the notches 23 and 24.

The resilient cylindrical sleeves 20 have a generally cylindrical outside surface 30 and have a relatively rigid ring 31 fixed to their outer end by cement or other suitable adhesive. The inner surface of the resilient cylindrical sleeve 20 is barrel shaped so that the ends are thickened and the wall is thinner at a position spaced from the ends. It has the thickened end portion at 38 and 39, and the thin intermediate part 37.

The side walls of the sleeve are approximately half as thick at the thin part as at their ends. The resilient cylindrical sleeves 20 urge the shafts 17 outwardly so that the pins 15 reset in either the notches 23 or the notches 24. When the pins 15 are resting in the notches 23, the blades 11 will be held in a position to move the air in one direction over the engine. When the blades are reversed so that the pins 15 are received in the notches 24, the blades 11 will be held in the reverse position to blow air in the opposite direction. The thin intermediate part of said rubber sleeve causes said sleeve to form wavy convolutions between its ends when compressed. The thickened end at 38 is cylindrical in shape.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a fan for an engine comprising a fanring, circumferentially spaced diametrically extending bore means in said ring, a plurality of blades, a shaft on each said blade, each said shaft baeing slidably received in one of said bore means, limit means on each said shaft limiting the outward movement of an rotation of said blades on said ring, resilient sleeve means on each said shaft urging said blades to move radially outwardly against said limit means, said blades being adapted to be moved radially inwardly from said limit means and rotated between a first position to a second position, said resilient sleeve means comprising a hollow cylinder made of resilient material having the properties of neoprene, said sleeve means having an outer end, an inner end and an intermediate part, the walls of said sleeve at said ends being relatively thick and tapered to a relatively thin wall at said intermediate part, said sleeve in normal position having a barrel shaped inner periphery, said cylindrical walls of said sleeve in their compressed position taking a wavy shape, one of said ends of said sleeve having a relatively rigid ring made of nylon material attached thereto resting on a said blade providing a low frictional resistance against blade rotation and the other said thickened ends resting on said fan ring, said hollow cylinders being compressed longitudinally by said blades whereby said sleeve walls urge said blades to move outwardly, and said nylon ring being adapted to slide on said blade when said blade is rotated.

* * * * *